US007765729B2

(12) United States Patent
Thurston

(10) Patent No.: US 7,765,729 B2
(45) Date of Patent: Aug. 3, 2010

(54) GREETING CARD DISPLAY

(76) Inventor: Nancy Anne Thurston, P.O. Box 34204, Richmond, VA (US) 23234

( * ) Notice: Subject to any disclaimer, the term of this patent is extended or adjusted under 35 U.S.C. 154(b) by 221 days.

(21) Appl. No.: 11/939,256

(22) Filed: Nov. 13, 2007

(65) Prior Publication Data

US 2009/0119958 A1 May 14, 2009

(51) Int. Cl.
*G09F 23/00* (2006.01)

(52) U.S. Cl. ..... 40/661; 40/645; 40/606.01

(58) Field of Classification Search ..... 40/645, 40/661, 606.01, 607.01, 607.03, 607.05, 40/607.11
See application file for complete search history.

(56) References Cited

U.S. PATENT DOCUMENTS

| | | | | | |
|---|---|---|---|---|---|
| 811,264 | A * | 1/1906 | Waterhouse | ..... | 40/611.06 |
| 1,674,005 | A * | 6/1928 | Eschenbach | ..... | 40/645 |
| 1,732,389 | A * | 10/1929 | Timm | ..... | 40/607.14 |
| 3,352,039 | A * | 11/1967 | Hoeve et al. | ..... | 40/661 |
| 3,874,103 | A | 4/1975 | Muta | | |
| 4,144,664 | A | 3/1979 | De Korte | | |
| D268,849 | S | 5/1983 | Shuman | | |
| D364,042 | S * | 11/1995 | Chavez et al. | ..... | D6/314 |
| 6,253,478 | B1 * | 7/2001 | Kalavity | ..... | 40/645 |
| 6,405,742 | B1 * | 6/2002 | Driscoll | ..... | 135/96 |
| 6,421,942 | B1 * | 7/2002 | Galello | ..... | 40/738 |

* cited by examiner

*Primary Examiner*—Cassandra Davis
(74) *Attorney, Agent, or Firm*—Dale J. Ream

(57) ABSTRACT

A greeting card display includes a sleeve having transparent front and rear walls, first and second ends, a top, and a bottom. The front and rear walls are unitary at the first and second ends and at the top but are separable at the bottom to define a weatherproof receiving area accessible only adjacent the bottom. The receiving area is configured to receive a greeting card. A mounting rod includes a first portion coupled to the sleeve and a second portion configured to attach to one of a flower urn and a ground surface. The front and rear walls have first and second lateral portions that converge at a spine, the first lateral portion being angularly biased relative to the second lateral portion. The front and rear walls collectively define an access opening the first lateral portion and an access opening the second lateral portion.

18 Claims, 7 Drawing Sheets

GREETING CARD DISPLAY

BACKGROUND OF THE INVENTION

This invention relates generally to signs and display devices and, more particularly, to a greeting card display for use with a grave marker or flower urn.

Friends and relatives of a deceased person frequently desire to leave notes, cards, flowers, or other personal items on or near a headstone or grave marker. Unfortunately, these items are subject to damage or loss by weather elements such as wind and rain. It is also difficult to attach such items to a headstone in such a way as to be easily removable. Various display devices have been proposed in the industry for displaying advertisements, instructions, or other forms of greetings or decorations. Although assumably effective for their intended purposes, the existing devices are not particularly suitable for removable attachment to a flower urn associated with a grave marker, for clearly displaying all four panels of a standard greeting card, or for maintaining the card in a substantially waterproof environment.

Therefore, it would be desirable to have a greeting card display that may be removable mounted to a flower urn or staked in the ground, that clearly displays all panels of a greeting card, and that protects the card from exposure to moisture.

SUMMARY OF THE INVENTION

Therefore, a greeting card display according to the present invention includes a sleeve having transparent front and rear walls, first and second ends, a top, and a bottom. The front rear walls are unitary at the first and second ends and at the top but are separable at the bottom to define a weatherproof receiving area accessible only adjacent the bottom. The receiving area is configured to receive a greeting card. A mounting rod includes a first portion coupled to the sleeve and a second portion configured to attach to one of a flower urn and a ground surface. The front and rear walls have first and second lateral portions that converge at a spine, the first lateral portion being angularly biased relative to the second lateral portion. The front and rear walls collectively define an access opening in the first lateral portion and an access opening in the second lateral portion. Each access opening extends from the bottom toward the top and allows access to the greeting card when the greeting card is in the weatherproof receiving area. Removable clips may be removable attached to the sleeve so as to close respective access openings and prevent a greeting card from sliding out of the receiving area.

Therefore, a general object of this invention is to provide a greeting card holder for holding a greeting card adjacent a headstone or similar monument.

Another object of this invention is to provide a greeting card holder, as aforesaid, that may be attached to a flower urn or positioned in a ground surface.

Still another object of this invention is to provide a greeting card holder, as aforesaid, that includes a substantially transparent sleeve defining a waterproof area for receiving a greeting card.

Yet another object of this invention is to provide a greeting card holder, as aforesaid, that clearly displays all four panels of a greeting card.

A further object of this invention is to provide a greeting card holder, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A greeting card display 100 according to the present invention will now be described in detail with reference to FIGS. 1 through 8 of the accompanying drawings. More particularly, according to the current invention, a greeting card display 100 includes a sleeve 110 and a mounting rod 140.

Figure 6:
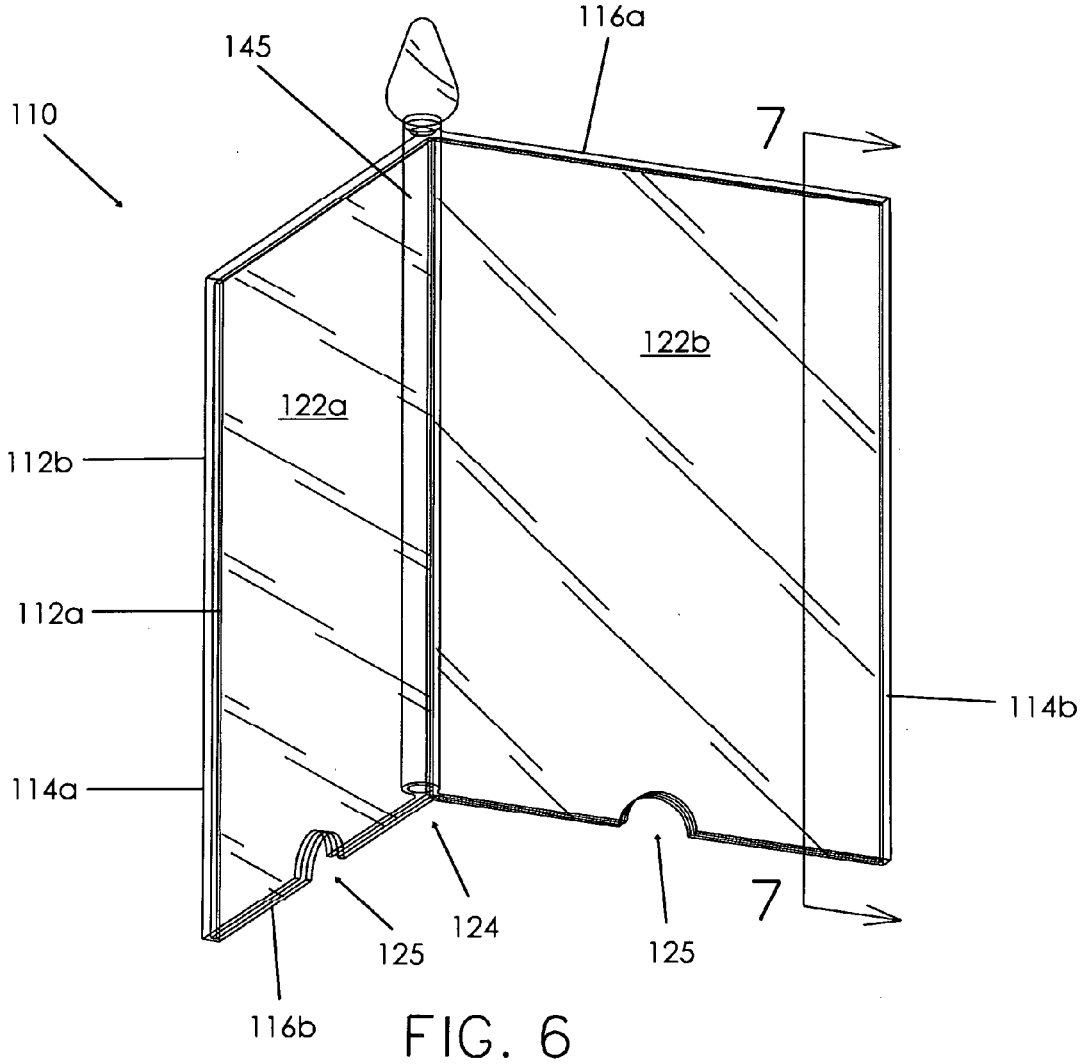
FIG. 6 is an isolated view on an enlarged scale of a sleeve as in FIG. 3.
Figure 7:
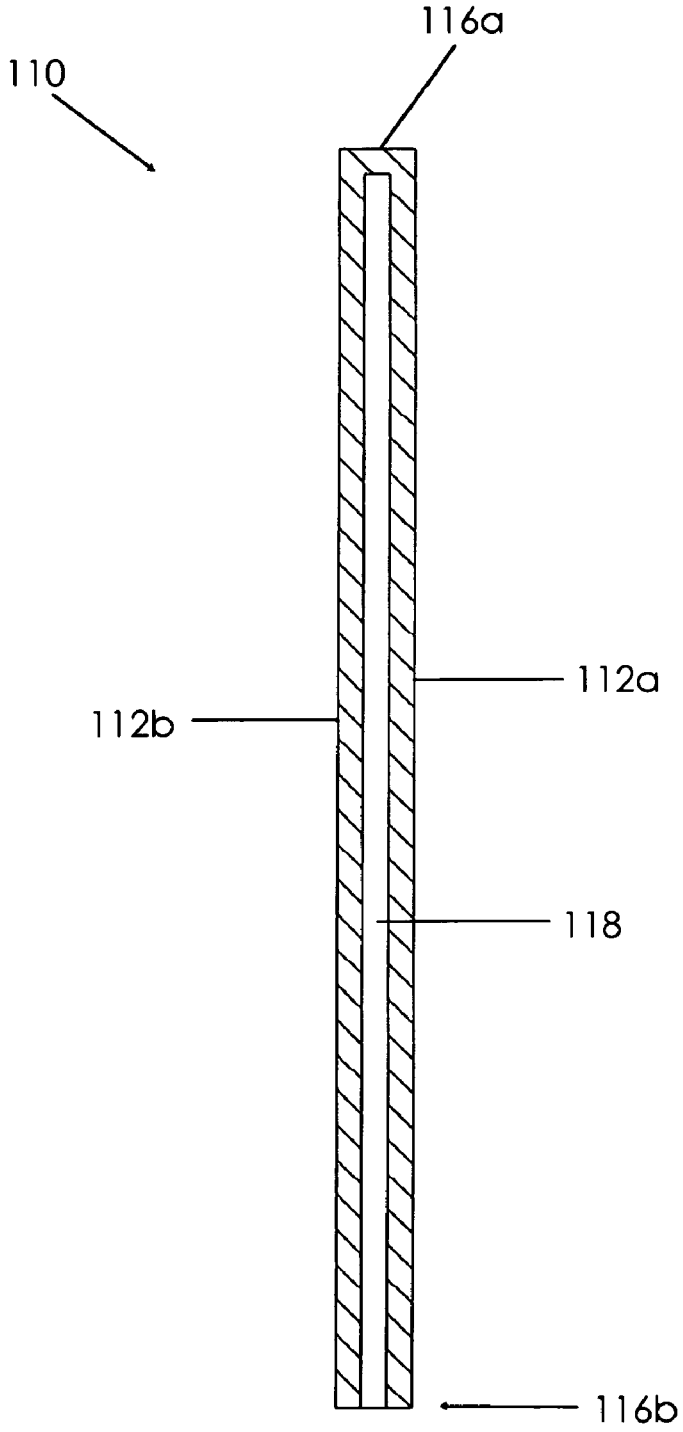
FIG. 7 is a sectional view taken from line 7-7 of FIG. 6.

As shown in FIGS. 6 and 7, the sleeve 110 has transparent front and rear walls 112*a*, 112*b*, first and second ends 114*a*, 114*b*, a top 116*a*, and a bottom 116*b*. The front and rear walls 112*a*, 112*b* are separable at the bottom 116*b* and unitary at the first and second ends 114*a*, 114*b* and the top 116*a* to define a weatherproof receiving area 118 accessible only adjacent the bottom 116*b*. In other words, the front and rear walls 112*a*, 112*b* may be constructed from a single piece of material or coupled together at the first and second ends 114*a*, 114*b* and the top 116*a* to form a pocket 118 accessible at the bottom 116*b*. The receiving area 118 is configured to receive (i.e., enclose) a greeting card (not shown).

The front and rear walls 112*a*, 112*b* have first and second lateral portions 122*a*, 122*b* that converge at a spine 124, and the first lateral portion 122*a* is angularly biased (or in other words, angularly offset) from the second lateral portion 122*b*. While it is currently preferred that the first lateral portion 122*a* is angularly biased relative to the second lateral portion 122*b* at an angle between about ninety degrees and about one hundred and twenty degrees, as shown throughout the drawings, other angles may also be appropriate. The first and second lateral portions 122*a*, 122*b* may preferably be of generally equivalent size, though this need not be the case.

Still referring to FIGS. 6 and 7, the front and rear walls 112*a*, 112*b* may collectively define one or more access opening 125 adjacent the bottom 116*b* that allows access to a greeting card (not shown) in the weatherproof receiving area 118. The embodiment shown in FIG. 6 has an access opening 125 in both the first and second lateral portions 122*a*, 122*b* that extends from the bottom 116*b* toward the top 116*a*.

At least one clip 130 (FIG. 4) may be removably attached to the sleeve 110. More particularly, display 100 may include at least one clip 130 configured to cover a respective access opening 125 and interact with the front and rear walls 112*a*, 112*b* when attached to the sleeve 110. A first portion 132*a* of the clip 130 may be biased inwardly relative to a second portion 132*a* of the clip 130 (e.g., due to a mechanical configuration, magnetic configuration, etc.) to bias the front wall 112*a* toward the rear wall 112*b* and maintain the greeting card (not shown) in the weatherproof receiving area 118 when the clip 130 is attached to the sleeve 110.

Figure 1:
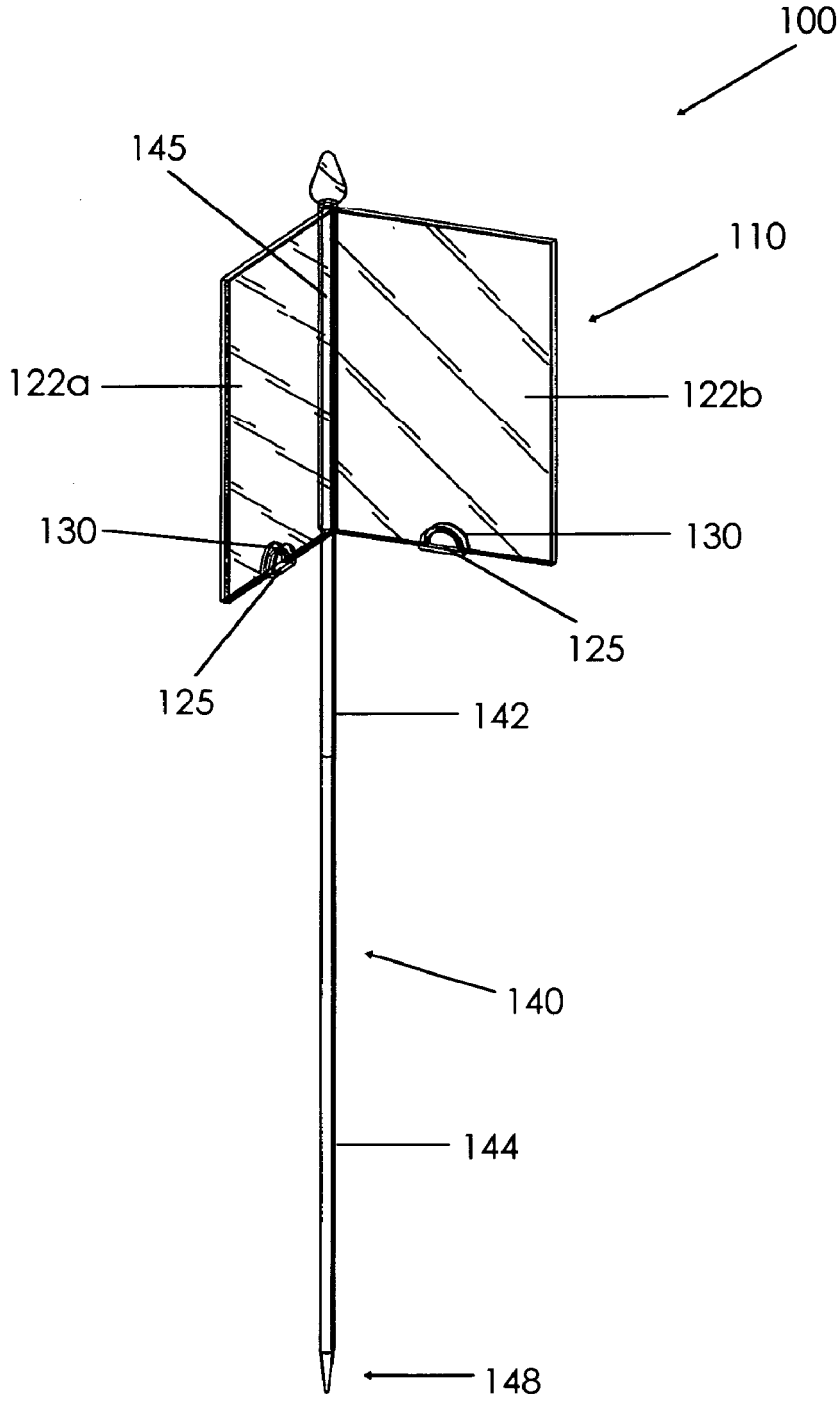
FIG. 1 is a perspective view of a greeting card display device according to a preferred embodiment of the present invention with a lower portion having a stake configuration.
Figure 2:
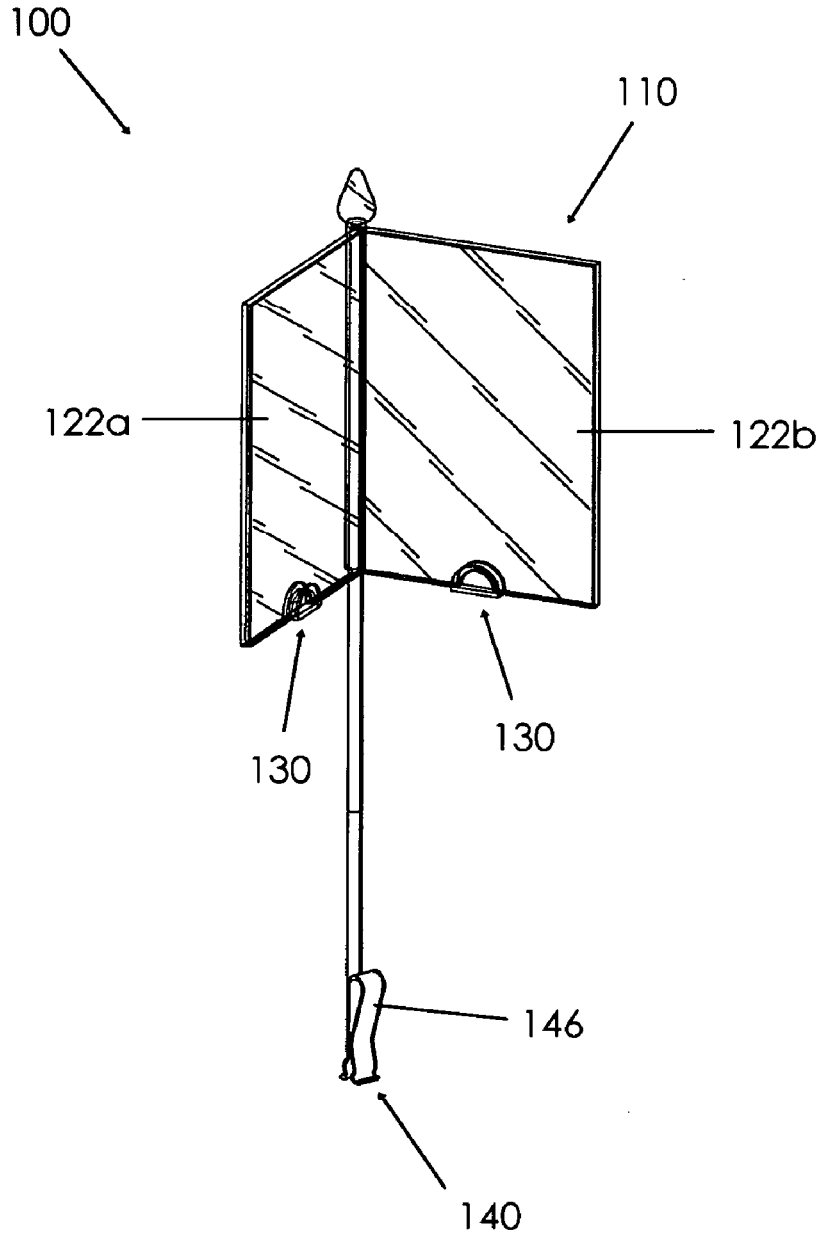
FIG. 2 is a perspective view of a greeting card display device according to a another embodiment of the present invention with a lower portion having a clip configuration.

The mounting rod 140 has an upper portion 142 coupled to the sleeve 110 and a lower portion 144 configured to attach to a flower urn 10 or a ground surface (including dirt inside the flower urn 10). The upper portion 142 may be coupled to the sleeve 110 adjacent the spine 124, and as shown in FIGS. 1 and 6, a receiving member 145 may be permanently coupled to the sleeve 110 and the upper portion 142 may be permanently or removably coupled to the receiving member 145. While the receiving member 145 is shown to engulf part of the upper portion 142, the receiving member 145 may alternately be a clip or other appropriate fastener or the upper portion 142 may otherwise be attached to the sleeve 110.

Figure 3:
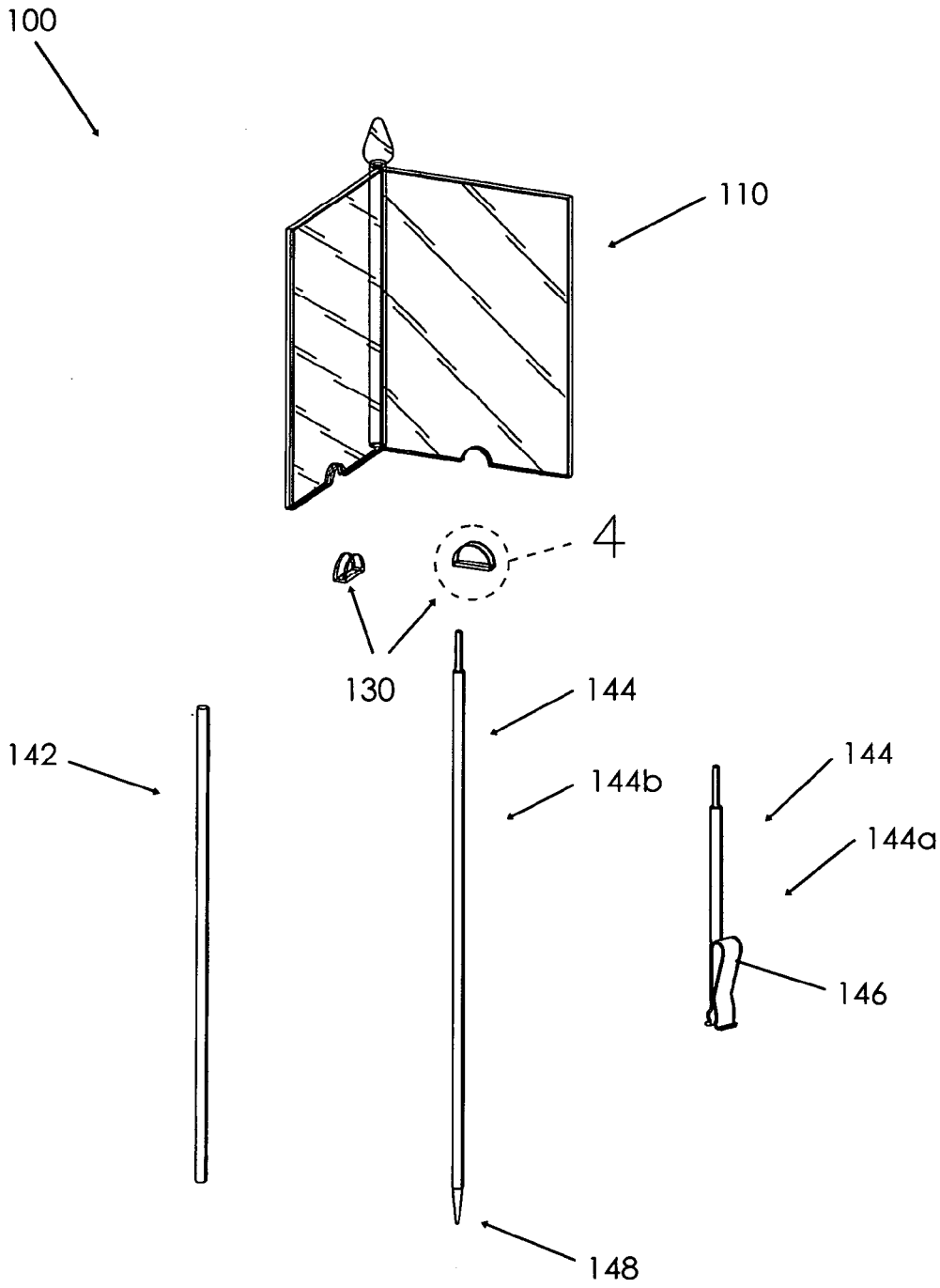
FIG. 3 is an exploded view of the display device shown in FIGS. 1 and 2.
Figure 4:
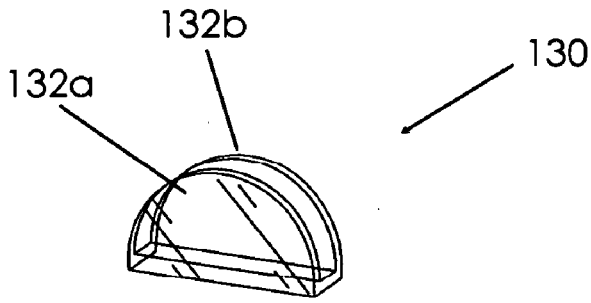
FIG. 4 is an isolated view on an enlarged scale of a clip as in FIG. 3.
Figure 5:
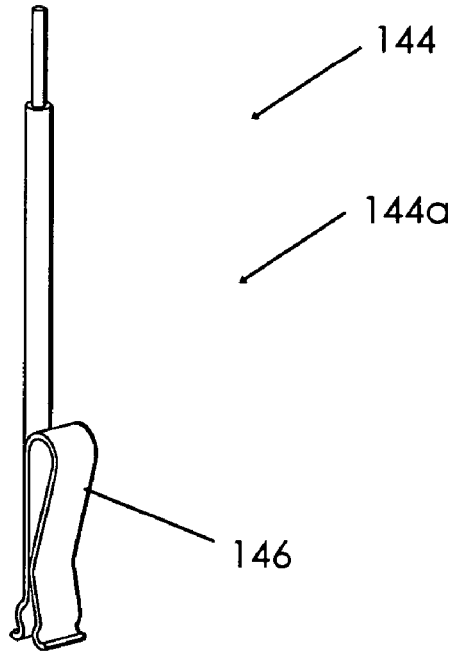
FIG. 5 is an isolated view on an enlarged scale of a clip-type lower portion as in FIG. 3.

In one embodiment, multiple lower portions 144 that can be interchangeably coupled with the portion 142 are included, as shown in FIG. 3, though only one lower portion 144 may be coupled to the upper portion 142 at any given time. One lower portion 144*a* may have a clip 146 (FIGS. 2 and 3) configured for removable attachment to the flower urn 10, and another lower portion 144*b* may have a stake configuration 148 for removable attachment to the ground surface, for example.

Figure 8:
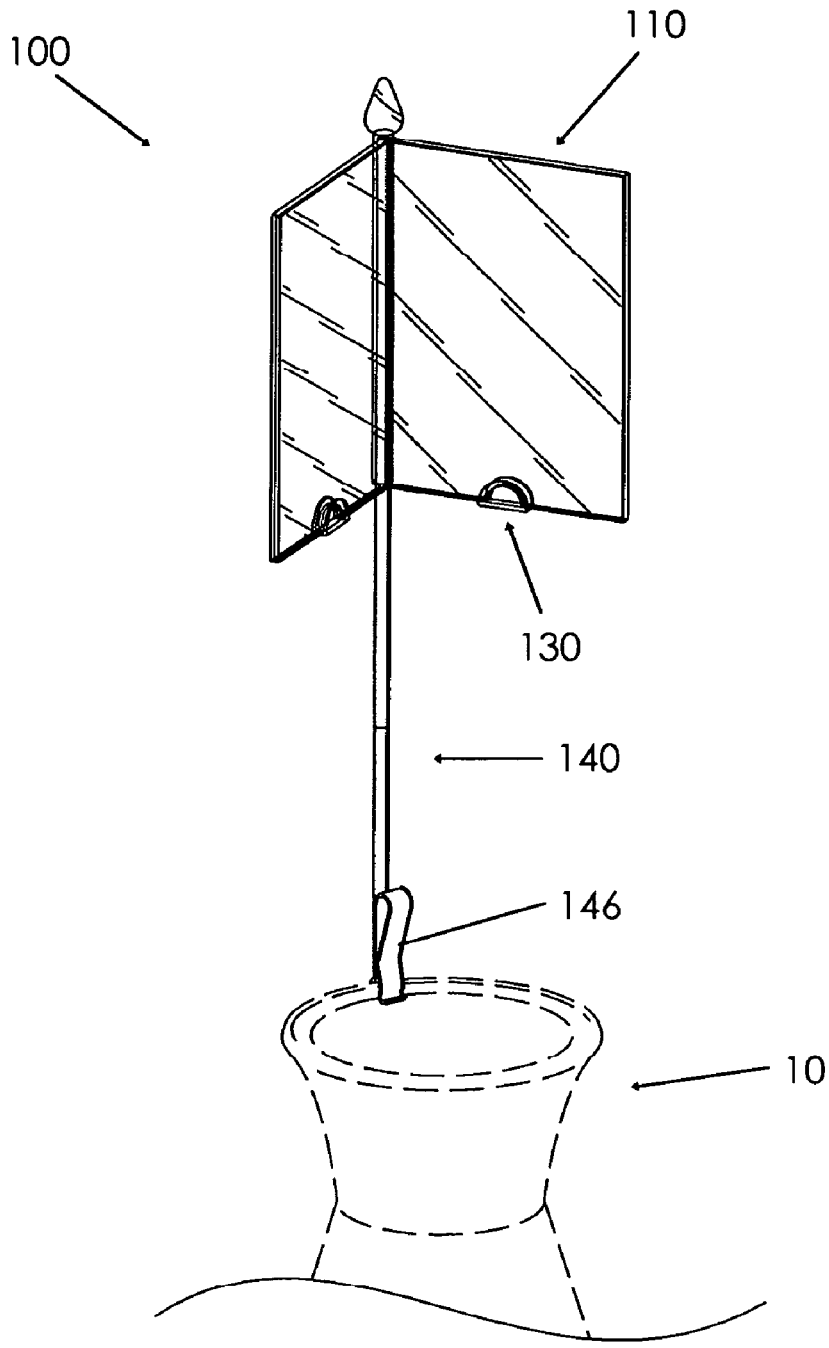
FIG. 8 is a perspective view of the greeting card display device as in FIG. 2 in use with a flower urn.

In use, a greeting card may be inserted into the receiving area 118 through the opening at the bottom 116*b*, and the clip(s) 130 may be placed over the access opening(s) 125 to maintain the card inside the receiving area 118. If interchangeable mounting rod lower portions 144 are included, the portion having the desired lower portion configuration (i.e., the configuration to attach to the flower urn 10 or the configuration to attach to the ground surface) may be selected and attached to the mounting rod upper portion 142. The mounting rod lower portion 144 may then be coupled to the flower urn 10 (i.e., using clip 146 as shown in FIG. 8) or the ground surface (i.e., using the stake configuration 148). The angle between the first and second lateral portions 122*a*, 122*b* may allow all sides of the greeting card to be displayed, and the waterproof nature of the receiving area 118 may allow the display 100 to be used in inclement weather. To remove the card from the display 100, the clip(s) 130 may be removed and the card may be accessed at the access opening(s) 125.

It is understood that while certain forms of this invention have been illustrated and described, it is not limited thereto except insofar as such limitations are included in the following claims and allowable functional equivalents thereof.

The invention claimed is:

1. A greeting card display, consisting of:

a sleeve having transparent front and rear walls, first and second ends, a top, and a bottom, said front and rear walls being unitary at said first and second ends and said top and being separable at said bottom to define a weatherproof receiving area accessible only adjacent said bottom, said receiving area being configured to receive a greeting card;

a mounting rod having a first portion coupled to said sleeve and a second portion configured to attach to one of a flower urn and a ground surface;

wherein said front and rear walls have first and second lateral portions that converge at a spine, said first lateral portion being angularly off-set relative to said second lateral portion and said rod is coupled to the spine;

wherein said front and rear walls collectively define an access opening in said first lateral portion and an access opening in said second lateral portion, each said access opening extending from said bottom toward said top and allowing access to said greeting card when said greeting card is in said weatherproof receiving area; and a clip removably attached to said sleeve, said clip being configured to cover a respective access opening and interact with said front and rear walls when attached to said sleeve, said clip having a first portion biased inwardly relative to a second portion to bias said front wall toward said rear wall and maintain said greeting card in said weatherproof receiving area when said clip is attached to said sleeve.

2. The greeting card display as in claim 1, wherein said first lateral portion is angularly biased relative to said second lateral portion at an angle between about ninety degrees and about one hundred and twenty degrees.

3. The greeting card display as in claim 1, wherein said mounting rod second portion includes a clip configured for removable attachment to said flower urn.

4. The greeting card display as in claim 1, wherein said mounting rod second portion includes a stake configuration for removable attachment to said ground surface.

5. The greeting card display as in claim 1, wherein:

said mounting rod first portion is coupled to said sleeve adjacent said spine; and said first and second lateral portions are of generally equivalent size.

6. A weatherproof display for a greeting card, said display comprising:

a sleeve having transparent front and rear walls, first and second ends, a top, and a bottom, said front and rear walls being unitary at said first and second ends and said top and being open at said bottom to define a weatherproof receiving area accessible only adjacent said open bottom, said receiving area being configured to enclose said greeting card;

a mounting rod having a first portion coupled to said sleeve and a plurality of second portions removably coupled to said first portion, one said second portion having a clip configured for removable attachment to a flower urn, another said second portion having a stake configuration for removable attachment to a ground surface; and wherein said front and rear walls have first and second lateral portions that converge at a spine, said first lateral portion being angularly off-set relative to said second lateral portion and said rod is coupled to the spine.

7. The display as in claim 6, wherein only one said mounting rod second portion is coupled to said mounting rod first portion at any given time.

8. The display as in claim 6, wherein said front and rear walls collectively define an access opening in said first lateral portion and an access opening in said second lateral portion, each said access opening extending from said open bottom toward said top and allowing access to said greeting card when said greeting card is in said weatherproof receiving area.

9. The display as in claim 8, further comprising a clip removably attached to said sleeve, said clip being configured to cover a respective access opening and interact with said front and rear walls when attached to said sleeve, said clip having a first portion biased inwardly relative to a second portion to bias said front wall toward said rear wall and maintain said greeting card in said weatherproof receiving area when said clip is attached to said sleeve.

10. The display as in claim 6, wherein said front and rear walls collectively define an access opening in at least one of said first and second lateral portions, said access opening being adjacent said bottom and allowing access to said greeting card when said greeting card is in said weatherproof receiving area.

11. The display as in claim 10, further comprising a clip removably attached to said sleeve, said clip being configured to cover said access opening and interact with said front and rear walls when attached to said sleeve, said clip having a first portion biased inwardly relative to a second portion to bias said front wall toward said rear wall and maintain said greeting card in said weatherproof receiving area when said clip is attached to said sleeve.

12. The display as in claim 11, wherein:

said mounting rod first portion is coupled to said sleeve adjacent said spine;

said first and second lateral portions are of generally equivalent size; and said first lateral portion is angularly biased relative to said second lateral portion at an angle between about ninety degrees and about one hundred and twenty degrees.

13. A greeting card display, comprising:

a sleeve having transparent front and rear walls, first and second ends, a top, and a bottom, said front and rear walls being unitary at said first and second ends and said top and being open and unshielded at said bottom to define a weatherproof receiving area accessible only through said open bottom, said receiving area being configured to receive a greeting card;

a mounting rod having a first portion coupled to said sleeve, a second portion configured to attach to a flower urn, and a third portion configured to attach to a ground surface, said second and third portions being interchangeably coupled to said first portion;

wherein said front and rear walls have first and second lateral portions that converge at a spine, said first lateral portion being angularly off-set relative to said second lateral portion and said rod is coupled to the spine; and wherein said front and rear walls collectively define an access opening in at least one of said first and second lateral portions, said access opening being adjacent said bottom and allowing access to said greeting card when said greeting card is in said weatherproof receiving area.

14. The greeting card display as in claim 13, further comprising a clip removably attached to said sleeve, said clip being configured to cover said access opening and interact with said front and rear walls when attached to said sleeve, said clip having a first portion biased inwardly relative to a second portion to bias said front wall toward said rear wall and maintain said greeting card in said weatherproof receiving area when said clip is attached to said sleeve.

15. The greeting card display as in claim 14, wherein:

said mounting rod first portion is coupled to said sleeve adjacent said spine; and said first and second lateral portions are of generally equivalent size.

16. The greeting card display as in claim 15, wherein said first lateral portion is angularly offset relative to said second lateral portion at an angle between about ninety degrees and about one hundred and twenty degrees.

17. The greeting card display as in claim 16, wherein a receiving member is permanently coupled to said sleeve and said mounting rod first portion is removably coupled to said receiving member.

18. The greeting card display as in claim 16, wherein a receiving member is permanently coupled to said sleeve and said mounting rod first portion is permanently coupled to said receiving member.

* * * * *